US005819379A

United States Patent [19]

Van Hout et al.

[11] Patent Number: 5,819,379

[45] Date of Patent: Oct. 13, 1998

[54] BELT CLIP

[75] Inventors: Cornelis Franciscus Van Hout, Denestraat 5, NL-5541 RL, Reusel; Rogélio Patric Keijser, Veldhoven; Darwin Franciscus Leonardus Van Hout, Reusel, all of Netherlands

[73] Assignee: Cornelis Franciscus Van Hout, Netherlands

[21] Appl. No.: 702,556

[22] PCT Filed: Mar. 20, 1995

[86] PCT No.: PCT/NL95/00104

§ 371 Date: Nov. 4, 1996

§ 102(e) Date: Nov. 4, 1996

[87] PCT Pub. No.: WO95/25445

PCT Pub. Date: Sep. 28, 1995

[30] Foreign Application Priority Data

Mar. 18, 1994 [NL] Netherlands ..... 9400425

[51] Int. Cl.[6] ..... A44B 11/00

[52] U.S. Cl. ..... 24/182; 24/530

[58] Field of Search ..... 224/666; 24/543, 24/530, 458, 545, 3.11, 3.12, 182, 265 EC

[56] References Cited

U.S. PATENT DOCUMENTS

| | | | |
|---|---|---|---|
| 304,692 | 9/1884 | Bingaman | 24/530 X |
| 1,283,037 | 10/1918 | Baltzley | 24/543 X |
| 1,682,536 | 8/1928 | Otten | 24/543 X |
| 2,084,738 | 6/1937 | Manker | 24/458 X |
| 3,182,368 | 5/1965 | Fair | 24/3.12 X |
| 4,280,254 | 7/1981 | Racke . | |
| 5,129,126 | 7/1992 | Huang | 24/3.11 |
| 5,251,361 | 10/1993 | Owens et al. | 24/182 |
| 5,274,318 | 12/1993 | Nordberg et al. | 224/666 X |
| 5,297,318 | 3/1994 | Adolphson et al. | 224/666 X |

FOREIGN PATENT DOCUMENTS

| | | | |
|---|---|---|---|
| 27 07 896 | 8/1978 | Germany . | |
| 42850 | 5/1926 | Norway | 24/182 |

*Primary Examiner*—James R. Brittain
*Attorney, Agent, or Firm*—Banner & Witcoff, Ltd.

[57] ABSTRACT

A belt clip (1) for enclosing together two parts of a belt which extend substantially parallel, wherein the belt clip (1) comprises a rigid plate (2) manufactured from substantially rigid material; a spring plate (4) manufactured from resilient material and extending substantially parallel to the rigid plate; and a connecting element (3) connecting the rigid plate (2) to the spring plate (4), wherein the spring plate is bent and is fixed with its bent part to the connecting element (3). Such a belt clip is used, for instance, to enclose a loose end of a belt or waistband worn on the body together with the part of the belt or waistband tightened around the body by means of a buckle. This prevents the loose end of the belt or waistband handing downward, which would result in a less pleasing appearance.

20 Claims, 4 Drawing Sheets

BELT CLIP

FIELD OF THE INVENTION

The present invention relates to a belt clip for enclosing together two parts of a belt which extend substantially parallel, wherein the belt clip comprises:

- a rigid plate manufactured from substantially rigid material;
- a spring plate manufactured from resilient material and extending substantially parallel to the rigid plate; and
- a connecting element connecting the rigid plate to the spring plate.

BACKGROUND OF THE INVENTION

Such a belt clip is known from the German utility model 9016356.7.

Such a belt clip is used for instance to enclose a loose end of a belt or waistband worn on the body together with the part of the belt or waistband tightened round the body by means of a buckle. This prevents the loose end of the belt or waistband hanging downward, which would result in a less pleasing appearance. The belt clip as known from the above literature reference avoids such a problem.

In this known belt clip the spring plate is rigidly fixed to a connecting element. This means that the force for securing the two belt parts to each other must be generated by the spring plate itself. This implies that the spring plate can only exert a sufficiently large clamping force on both belt parts at its bottom end, so that the spring plate only exerts a small force on the upper portion of the belt parts where the clamping effect is small. In addition, this prior art spring clip is only effective with belt parts of a predetermined width; when belt parts are used of a smaller thickness the clamping force ranges from small to none at all, while arrangement of the belt clip in the case of thick belts, wherein of course sufficient clamping force can be generated, is very difficult because the large clamping force results in much friction.

The object of the present invention is to avoid the above stated problems.

SUMMARY OF THE INVENTION

The present invention relates to a belt clip for enclosing together two parts of a belt which extend substantially parallel, wherein the belt clip comprises a rigid plate manufactured from substantially rigid material; a spring plate manufactured from resilient material and extending substantially parallel to the rigid plate; and a connecting element connecting the rigid plate to the spring plate.

This object is achieved in that the spring plate is bent and is fixed with its bent part to the connecting element.

This means that the clamping force with which the spring plate presses against the enclosed belt parts is generated not only by the spring force of the actual spring plate but also by the bent part where the bent part of the spring plate is connected to the actual spring plate, whereby a sufficiently large force is also exerted at the upper half of the spring plate in order to obtain a good clamping action.

According to a first preferred embodiment the connecting element is formed integrally with the rigid plate. This has the advantage from the point of view of production technique that only a single component need be manufactured.

According to another preferred embodiment the bent part of the spring plate is connected to the connecting element by means of a clamping connection.

According to yet another embodiment the spring plate is bent through. an angle such that a gap is present between the edge of the part of the rigid plate extending to the spring plate and the spring plate. This facilitates arrangement of the clip.

The present invention will subsequently be elucidated with reference to the annexed drawings, in which:

DETAILED DESCRIPTION OF THE DRAWINGS

Figure 1:
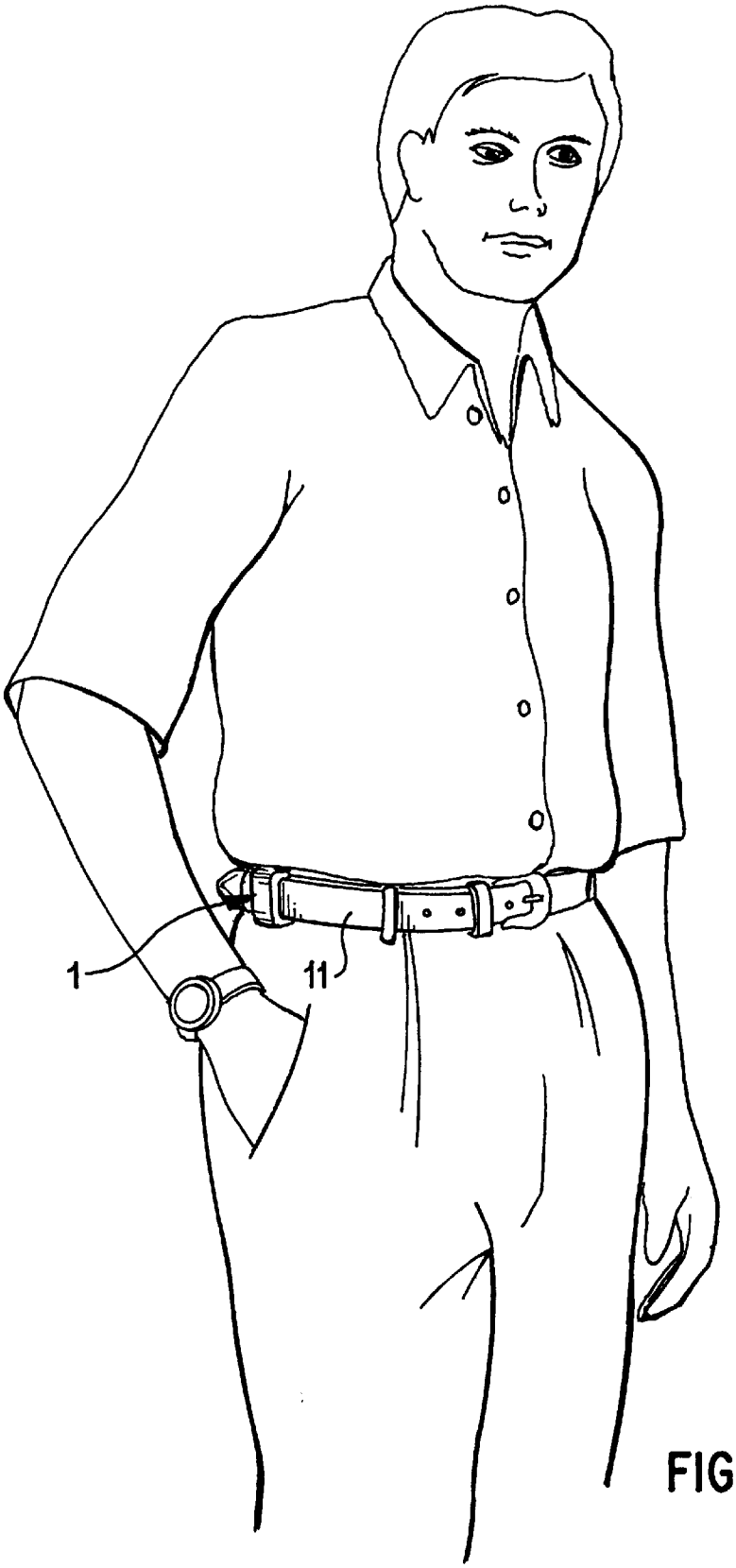
FIG. 1 shows an illustration depicting the use of the belt clip according to the present invention.
Figure 2:
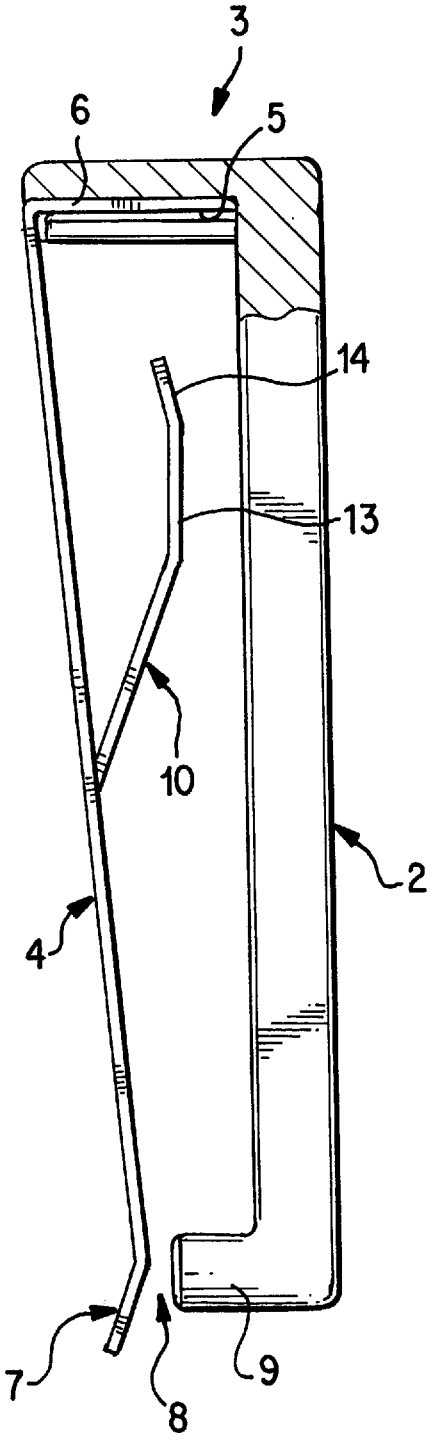
FIG. 2 is a side view of the belt clip according to the present invention.

The belt clip 1 shown in FIGS. 1 and 2 is formed by a rigid plate 2, a connecting element 3 and a spring plate 4. The rigid plate 2 is manufactured from rigid material, for instance metal or plastic, wherein the rigid plate is obtained by for instance casting or injection moulding.

In order to embellish the exterior of this rigid plate, which is generally worn on the outside of the belt, it is provided with a decorative layer, for instance a chrome layer.

It is also possible to apply other types of finish; for example in a precious metal. It is of course further possible to manufacture the rigid plate from a per se attractive material, for instance stainless steel. The front side of the plate can moreover be provided with a decoration.

The rigid plate 2 is formed integrally with the connecting element 3. Recessed into the connecting element 3 is a channel 5 into which a bent part 6 of the spring plate 4 is fixedly clamped. The spring plate 4 is manufactured for instance of spring steel and the spring plate 4 can likewise be chromium-plated.

Figure 3:
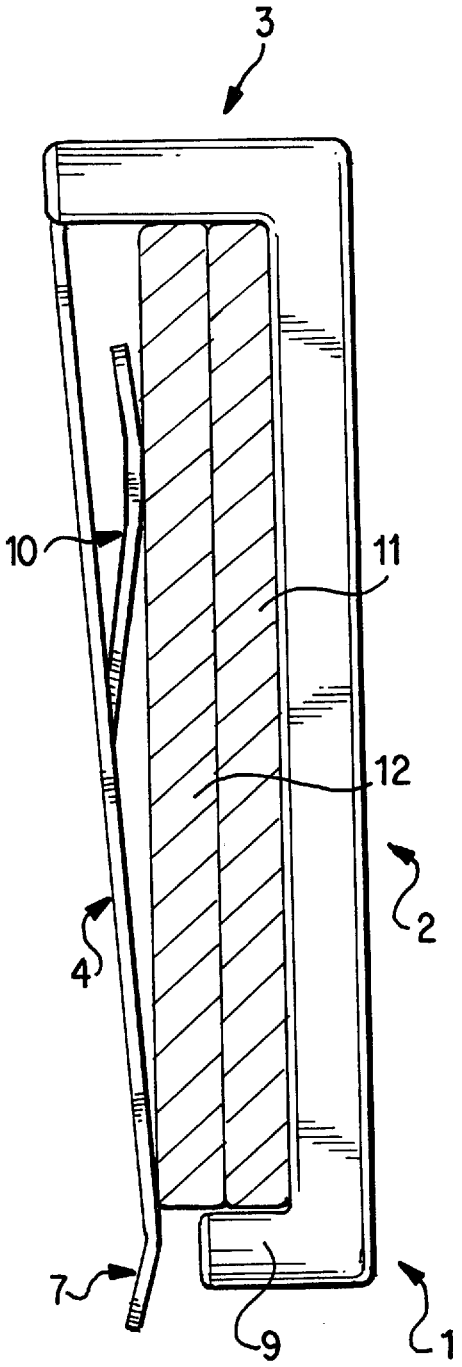
FIG. 3 is a view corresponding with FIG. 2, wherein the belt clip is arranged round two belt parts.

As can be seen in FIGS. 2 and 3, the lower portion 7 of spring plate 4 is bent. The lower part of the rigid plate 2 extends inward. This part is designated 9.

The part 9 ensures that the clip does not creep upward or, put another way, that neither of the belt parts 11,12 slips downward. In the situation shown in FIG. 1 a gap 8 is present between the part 9 and the portion 7. The bent portion 7 further extends below the bottom edge of the part 9. This configuration makes it possible, when the clip is arranged, for the upper edge of the belt to be used to bend open the spring plate 4 by means of the bent portion 7. This facilitates arrangement of the belt clip. According to a preferred embodiment the bent portion is bent through an angle of 30°, but it is equally possible to apply other angles.

As shown in FIGS. 2 and 3, spring plate 4 is provided with an inward extending tongue 10 which, as a result of the fact that it is made of the same resilient material as spring plate 4, also displays a spring action. It will be apparent that as a result of the configuration shown, wherein the resilient plate extends at an angle toward the enclosed belt parts 11,12, the lower end of spring plate 4 exerts a force on the enclosed belt parts 11,12, while the tongue 10 exerts a clamping action for the upper part of the belt parts 11,12. The tongue 10 is also bent such that the upper portion 13 of this tongue extends substantially parallel to the spring plate 4. Furthermore, the top edge 14 of the tongue is turned toward the edge 4. The portion 13 ensures that a force is exerted in the case of differing thicknesses of the belt, while the further bent top portion 14 serves to facilitate removal of the clip.

Figure 4:
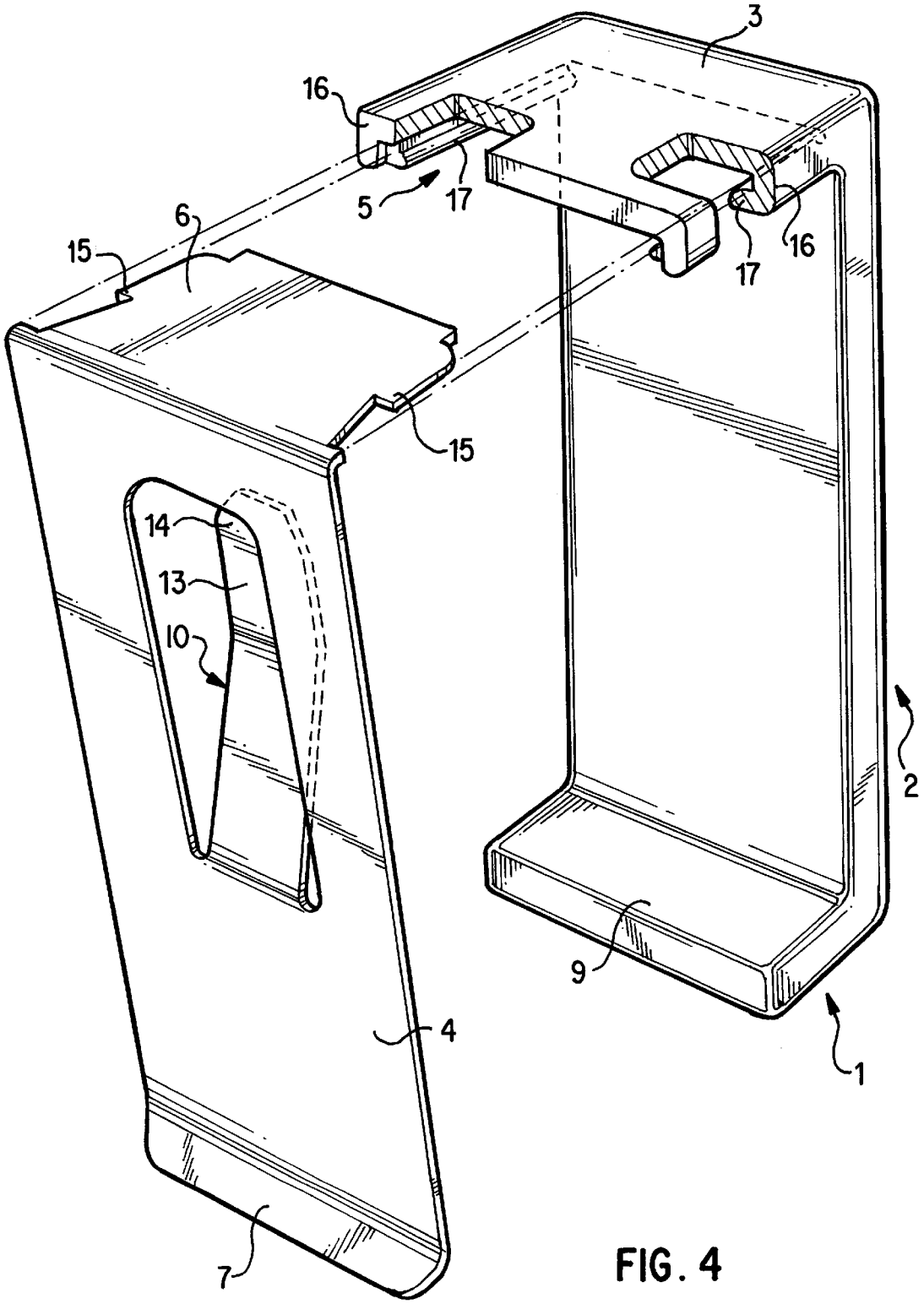
FIG. 4 is a partly broken away exploded view of the belt clip shown in FIGS. 2 and 3.

The construction of the belt clip is further shown with reference to FIG. 4. The bent part 6 of spring plate 4 is provided on its sides with teeth 15 with which fixation occurs when the bent part 6 is pushed into the channel 5.

Figure 5:
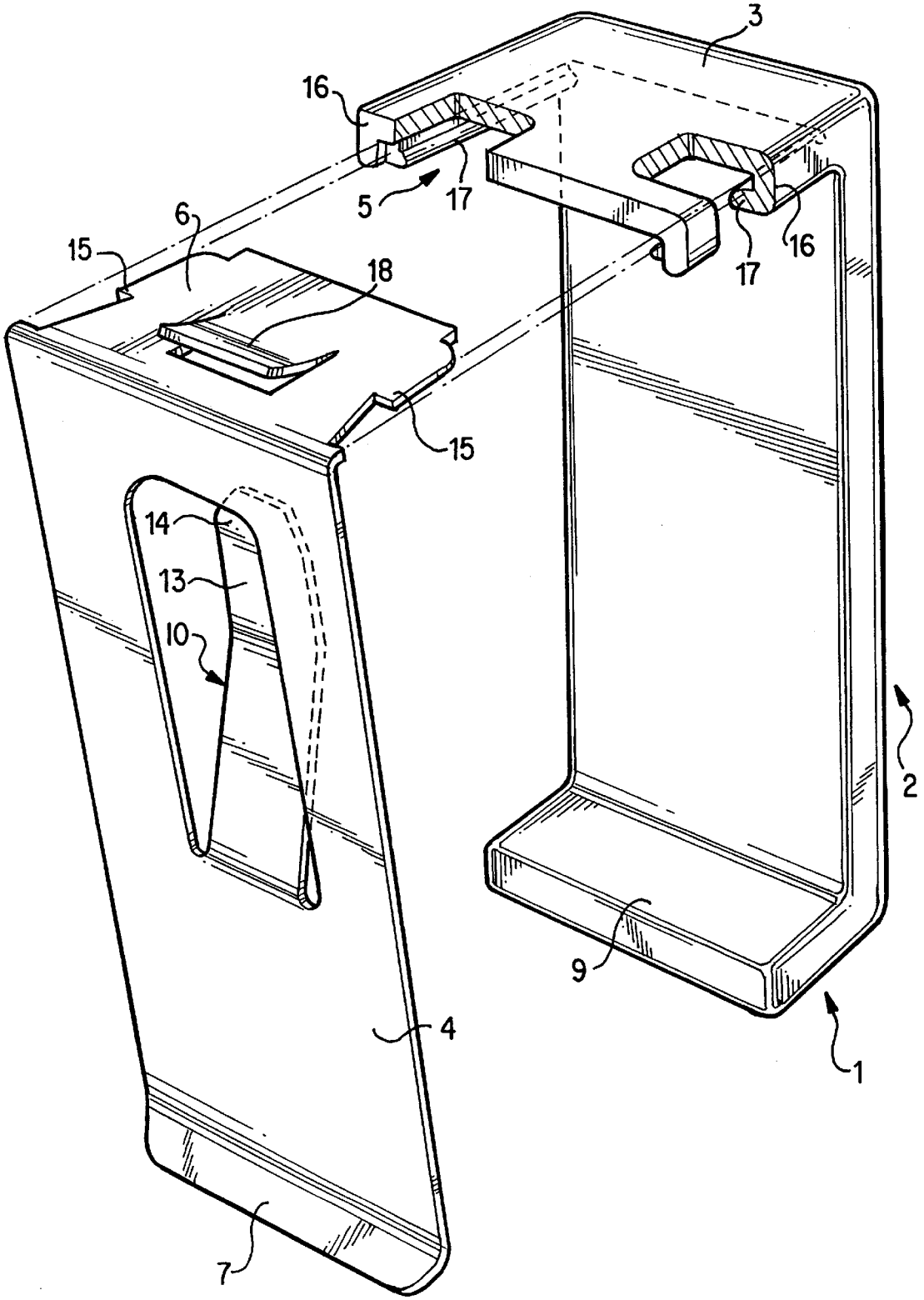
FIG. 5 is a view corresponding with FIG. 4 of a variant of the belt clip according to the invention.

The channel 5 is formed by downward extending cheeks 16 of the connecting element 3 which are provided on their underside with inward extending edges 17. The channel is thus enclosed by the connecting element 3, the cheeks 16 and edges 17. Fixation herein takes place by the teeth 15 against the inside of the cheeks 16. For assembly, both parts of the belt clip must be pressed together. It is then no longer possible to separate the two parts. It is of course possible to apply other fixing methods; FIG. 5 shows for instance a similar construction, wherein the bent part 6 is provided with an additional lip 18 which produces an extra clamping action against the underside of connecting element 3. For this purpose the underside of connecting element 3 can for instance be roughened or it can be provided with ribs extending parallel to the belt. This enhances fixation. It is of course also possible to apply other fixing methods, for example gluing, the use of a riveted connection or use of a screw connection.

It will be apparent that diverse variations of the shown embodiment are possible without falling outside the scope of the invention.

We claim:

1. Belt clip for enclosing together two parts of a belt which extend substantially parallel, wherein the belt clip comprises:

a) a rigid plate manufactured from substantially rigid material;

b) a spring plate manufactured from resilient material and having a first portion extending substantially parallel to the rigid plate and a second, bent portion; and c) a connecting element extending outwardly away from one end of said rigid plate and connecting the rigid plate to the spring plate, characterized in that said bent portion of said spring plate is fixed to the connecting element.

2. Belt clip as claimed in claim 1, characterized in that the connecting element is formed integrally with the rigid plate.

3. Belt clip as claimed in claim 2, characterized in that the rigid plate is provided on its lower end with a part extending to the spring plate.

4. Belt clip as claimed in claim 3, characterized in that the spring plate extends beyond the part extending to said spring plate.

5. Belt clip as claimed in claim 1, characterized in that the rigid plate is provided on its lower end with a part extending to the spring plate.

6. Belt clip as claimed in claim 5, characterized in that the part extending to the spring plate is shorter than the connecting element.

7. Belt clip as claimed in claim 6, characterized in that the part extending to the spring plate is formed integrally with the rigid plate.

8. Belt clip as claimed in claim 5, characterized in that said part extending to the spring plate is formed integrally with the rigid plate.

9. Belt clip as claimed in claim 8, characterized in that the spring plate is bent through an angle such that a gap is present between the edge of said part extending to the spring plate and the spring plate.

10. Belt clip as claimed in claiml 9, characterized in that the spring plate extends beyond said part extending to the spring plate.

11. Belt clip as claimed in claim 5, characterized in that the spring plate extends beyond the part extending to the spring plate.

12. Belt clip as claimed in claim 1, characterized in that the spring plate is bent outward on its bottom edge.

13. Belt clip as claimed in claim 12, characterized in that the spring plate is bent outward through an angle of 30° on its bottom edge.

14. Belt clip as claimed in claim 1, characterized in that out of the spring plate is punched a tongue which is directed upward with its free end and which is bent inward.

15. Belt clip as claimed in claim 14, characterized in that the tongue is provided on its top end with a bent portion which extends substantially parallel to the spring plate.

16. Belt clip as claimed in claim 1, characterized in that the bent portion of the spring plate is connected to the connecting element by means of a clamping connection.

17. Belt clip as claimed in claim 16, characterized in that the connecting element comprises a channel which is adapted to receive the bent portion of the spring plate.

18. Belt clip as claimed in claim 17, characterized in that the bent portion of the spring plate is provided with a fixation lip recessed therein.

19. Belt clip as claimed in claim 1, characterized in that at least one of the spring plate and the rigid plate is chromium-plated.

20. Belt clip as claimed in claim 1, characterized in that the rigid plate is provided on its front side with a decoration.

* * * * *